US012765682B2

(12) United States Patent
Deng

(10) Patent No.: US 12,765,682 B2
(45) Date of Patent: Oct. 20, 2026

(54) ERGONOMIC SIT-STAND CHAIR

(71) Applicant: Shenzhen Microtouch Ergonomic Technologies Inc., Shenzhen (CN)

(72) Inventor: Jianbo Deng, Shenzhen (CN)

(73) Assignee: Shenzhen Microtouch Ergonomic Technologies Inc., Shenzhen (CN)

( * ) Notice: Subject to any disclaimer, the term of this patent is extended or adjusted under 35 U.S.C. 154(b) by 119 days.

(21) Appl. No.: 18/967,686

(22) Filed: Dec. 4, 2024

(65) Prior Publication Data

US 2026/0108071 A1 Apr. 23, 2026

(30) Foreign Application Priority Data

Oct. 17, 2024 (CN) ..... 202422520317.X

(51) Int. Cl.

| | |
|---|---|
| ***A47C 9/02*** | (2006.01) |
| ***A47C 3/30*** | (2006.01) |
| ***A47C 7/14*** | (2006.01) |
| ***A47C 7/40*** | (2006.01) |
| ***A47C 15/00*** | (2006.01) |

(52) U.S. Cl.

CPC ..... *A47C 15/004* (2013.01); *A47C 3/30* (2013.01); *A47C 7/14* (2013.01); *A47C 7/402* (2013.01); *A47C 9/025* (2013.01)

(58) Field of Classification Search

CPC ..... A47C 9/025

See application file for complete search history.

(56) References Cited

U.S. PATENT DOCUMENTS

| | | | | |
|---|---|---|---|---|
| 5,542,748 | A * | 8/1996 | Barile | A47C 9/022 248/500 |
| 5,619,949 | A * | 4/1997 | Dick, Jr. | A47C 9/025 297/338 |
| 7,261,368 | B1 * | 8/2007 | Clausnitzer | A47C 9/002 297/118 |
| 7,887,136 | B2 * | 2/2011 | Zoell | A47C 9/025 297/284.3 |
| 8,220,872 | B2 * | 7/2012 | Hong | A47C 7/024 297/344.17 |

(Continued)

FOREIGN PATENT DOCUMENTS

| | | | | |
|---|---|---|---|---|
| EP | 179748 | A * | 4/1986 | A47C 9/025 |
| FR | 2718620 | A1 * | 10/1995 | A47C 9/025 |
| WO | WO-2024148273 | A1 * | 7/2024 | A47C 7/006 |

*Primary Examiner* — Rodney B White

(74) *Attorney, Agent, or Firm* — Bayramoglu Law Offices LLC

(57) ABSTRACT

An ergonomic sit-stand chair includes a first chair base, a pneumatic rod, and a first seat connected in sequence, as well as a first backrest and a backrest bracket, where the first seat is connected to one end of the backrest bracket, and the other end of the backrest bracket is movably connected to the first backrest; the first chair base is provided with a second chair base and a storage mechanism; and the second chair base is connected to the first chair base in a flipping manner through the storage mechanism. The ergonomic sit-stand chair achieves the standing function mainly through the second chair base. The ergonomic sit-stand chair utilizes the frictional force between the feet and the second chair base to balance the gravity generated in the leaning direction, preventing the chair from sliding displacement.

7 Claims, 4 Drawing Sheets

(56) References Cited

U.S. PATENT DOCUMENTS

| | | | | |
|---|---|---|---|---|
| 9,801,472 | B2 * | 10/2017 | Keen | A47C 7/5062 |
| 9,968,195 | B2 * | 5/2018 | Sheinkop | A47C 7/006 |
| 10,405,666 | B1 * | 9/2019 | Reus | A47C 9/002 |
| 10,638,846 | B2 * | 5/2020 | Smith | A47C 1/0244 |
| 11,160,704 | B2 * | 11/2021 | Stajic | A61G 5/14 |
| 11,375,816 | B1 * | 7/2022 | Deng | A47C 3/20 |
| 11,844,434 | B2 * | 12/2023 | Catan | A47C 1/024 |
| 11,850,195 | B2 * | 12/2023 | Stajic | A47C 13/00 |
| 12,133,596 | B2 * | 11/2024 | Catan | A47C 1/024 |
| 12,167,793 | B2 * | 12/2024 | Paz | A61G 5/14 |
| 12,226,031 | B2 * | 2/2025 | Benden | A47C 7/004 |
| 12,310,502 | B2 * | 5/2025 | Cooper | A47C 1/03255 |
| 2007/0052275 | A1 * | 3/2007 | Ghilzai | A47C 1/11 297/423.12 |
| 2012/0319444 | A1 * | 12/2012 | Onopa | A47C 9/005 297/354.12 |
| 2018/0199715 | A1 * | 7/2018 | Sheinkop | A47C 7/50 |
| 2023/0014385 | A1 * | 1/2023 | Kapij | A47C 7/024 |
| 2023/0232990 | A1 * | 7/2023 | Letow | A47C 9/025 297/301.1 |
| 2023/0232993 | A1 * | 7/2023 | Benden | A47C 7/004 297/129 |
| 2025/0185813 | A1 * | 6/2025 | Benden | A47C 7/006 |

* cited by examiner

ERGONOMIC SIT-STAND CHAIR

CROSS-REFERENCE TO THE RELATED APPLICATIONS

This application is based upon and claims priority to Chinese Patent Application No. 202422520317.X, filed on Oct. 17, 2024, the entire contents of which are incorporated herein by reference.

TECHNICAL FIELD

The present disclosure relates to the technical field of chairs, and in particular to an ergonomic sit-stand chair.

BACKGROUND

Long-term desk work can cause severe compression on the spine, leading to serious physical injuries such as scoliosis and lumbar muscle strain. Therefore, people need to get up and walk around appropriately to relax their bodies and reduce the harm of prolonged sitting. However, people sometimes need to work continuously and can hardly find time to relax.

In the prior art, Chinese utility model (CN214179789U) discloses a height-adjustable chair, including a seat provided with a lifting assembly for height adjustment and a horizontal base located below the seat. The user can stand through the seat and the horizontal base to work and adjust the most suitable support height by the lifting assembly. The seat can provide the user with a comfortable angle of use, allowing the user to work in a standing position. However, the chair mainly focuses on providing a standing position, and the design of the horizontal base increases the overall volume of the chair and makes it hard to be stored, resulting in inconvenience. Besides, the user cannot feel comfortable even in a sitting position. To solve the above technical problems, there is an urgent need for a reasonable ergonomic seat.

SUMMARY

The present disclosure provides an ergonomic sit-stand chair to solve the above-mentioned problems in the prior art, that is, the chair cannot provide both standing and comfortable sitting positions and its horizontal base occupies a large space.

In order to achieve the above objective, the present disclosure provides an ergonomic sit-stand chair, including a first chair base, a pneumatic rod, and a first seat connected in sequence, as well as a first backrest and a backrest bracket, where the first seat is connected to one end of the backrest bracket, and the other end of the backrest bracket is movably connected to the first backrest; the first chair base is provided with a second chair base and a storage mechanism; and the second chair base is connected to the first chair base in a flipping manner through the storage mechanism.

In an improvement solution of the present disclosure, the storage mechanism includes a fixing element, a first connecting element, and a second connecting element that are connected in sequence in a flipping manner; one end of the fixing element away from the first connecting element is fixedly provided on the first chair base; one end of the second chair base forms a connecting port; one end of the second connecting element away from the first connecting element is provided in the connecting port and connected to the second chair base in a flipping manner; and by flipping the first connecting element and the second connecting element, the second chair base is folded and stored between the first seat and the first chair base, with the connecting port coming into contact with the pneumatic rod.

In an improvement solution of the present disclosure, the ergonomic sit-stand chair further includes a second seat and an angle adjustment mechanism; the second seat is movably provided on the backrest bracket through the angle adjustment mechanism; and the second seat achieves angle adjustment relative to the backrest bracket through the angle adjustment mechanism.

In an improvement solution of the present disclosure, the angle adjustment mechanism is located on a backrest adjustment mechanism; the angle adjustment mechanism includes limit rods and clamping rods; one of the clamping rods includes one end slidably embedded in one of the limit rods and the other end hinged to the backrest adjustment mechanism; one end of at least one of the limit rods away from the clamping rod is hinged to the second seat; the limit rod is provided with at least one limit hole; multiple limit holes are spaced apart; and the clamping rod is provided with at least one limit protrusion that matches the limit hole.

In an improvement solution of the present disclosure, the ergonomic sit-stand chair further includes a second backrest, backrest adjustment mechanisms, and a connecting back plate; the first backrest is further provided with a chair headrest; the second backrest is opposite to the chair headrest; two opposite sides of the second backrest and the chair headrest are respectively embedded with the backrest adjustment mechanisms; and the connecting back plate is located between the second backrest and the chair headrest and is slidably connected to the backrest adjustment mechanisms of the second backrest and the chair headrest.

In an improvement solution of the present disclosure, the backrest adjustment mechanism includes a first sliding element and a second fixing element; the first sliding element is provided inside the second fixing element; the second fixing element is provided with a strip notch, and the first sliding element is provided with a strip groove; two sides of the connecting back plate are each provided with a connecting post; and the connecting post at each of the two sides of the connecting back plate is embedded into the strip groove of the first sliding element through the strip notch of the second fixing element, such that the connecting back plate is fixedly connected to the first sliding element.

In an improvement solution of the present disclosure, a surface of the second chair base is provided with an anti-slip layer Compared with the prior art, the present disclosure has the following beneficial effects. The present disclosure provides an ergonomic sit-stand chair, including a first chair base, a pneumatic rod, and a first seat connected in sequence, as well as a first backrest and a backrest bracket, where the first seat is connected to one end of the backrest bracket, and the other end of the backrest bracket is movably connected to the first backrest; the first chair base is provided with a second chair base and a storage mechanism; and the second chair base is connected to the first chair base in a flipping manner through the storage mechanism. The present disclosure mainly achieves the standing function through the second seat and the second chair base. When in use, the user leans against the second seat. The frictional force between the user's feet and the second chair base balances with the gravity generated by the user in the leaning direction, preventing the chair from sliding displacement. In order to improve force application, the chair headrest is further provided with the second backrest to allow the user to lean on multiple points of force. The combination of the chair headrest and the second seat enables a more comfortable standing position. The product can provide the user a comfortable sitting experience and a comfortable standing experience, and alleviate discomfort such as lumbar fatigue during prolonged sitting. The product has strong overall practicality and rich use methods.

REFERENCE NUMERALS

1. first seat; 2. first chair base; 3. pneumatic rod; 4. seat adjustment mechanism; 5. backrest bracket; 6. first backrest, 61. chair headrest; 62. connecting back plate; 63. connecting post; 7. second seat; 8. second chair base; 9. second backrest; 10. angle adjustment mechanism; 100. limit rod; 101. clamping rod; 102. limit hole; 103. limit protrusion; 11. storage mechanism; 110. fixing element; 111. first connecting element; 112. second connecting element; 113. hinge; 12. backrest adjustment mechanism; 120. first sliding element; 121. second fixing element; 122. strip notch; 123. limit slot; 124. limit tooth; and 13. connecting port.

DETAILED DESCRIPTION OF THE EMBODIMENTS

In order to help understand the present disclosure more clearly, the present disclosure is described in further detail below with reference to the drawings.

In the following description, details of examples are given to provide a more thorough understanding of the present disclosure. Apparently, the described embodiments are merely a part, rather than all of the embodiments of the present disclosure. It should be understood that the specific embodiments are merely intended to explain the present disclosure, rather than to limit the present disclosure.

It should be understood that terms such as "comprising" and/or "including" used in this specification specify the presence of features, entireties, steps, operations, components or assemblies, without excluding the presence or addition of one or more other features, entireties, steps, operations, components, assemblies and/or combinations thereof.

Figure 1:
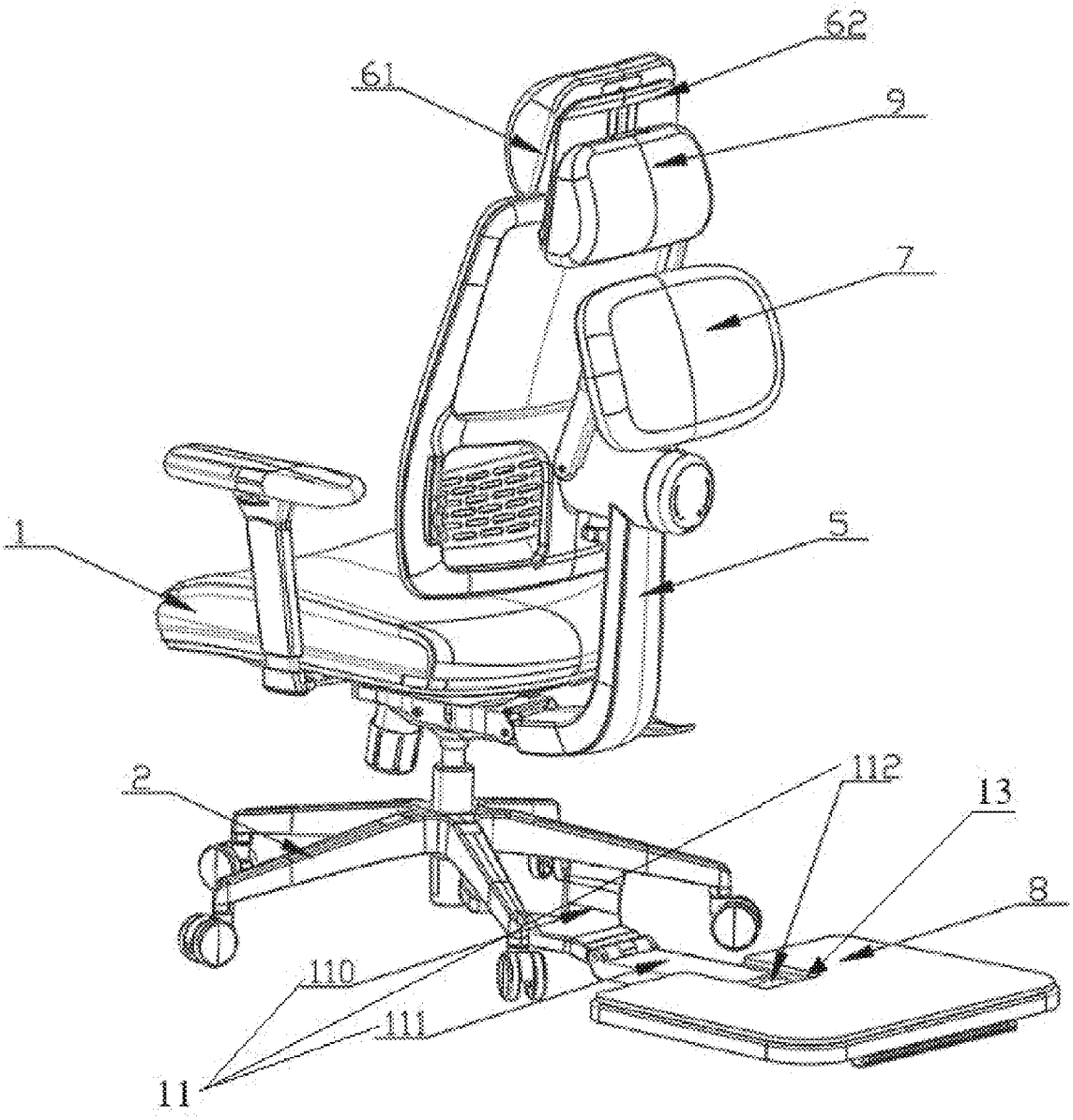
FIG. 1 is a stereoscopic view of an ergonomic sit-stand chair according to the present disclosure.
Figure 2:
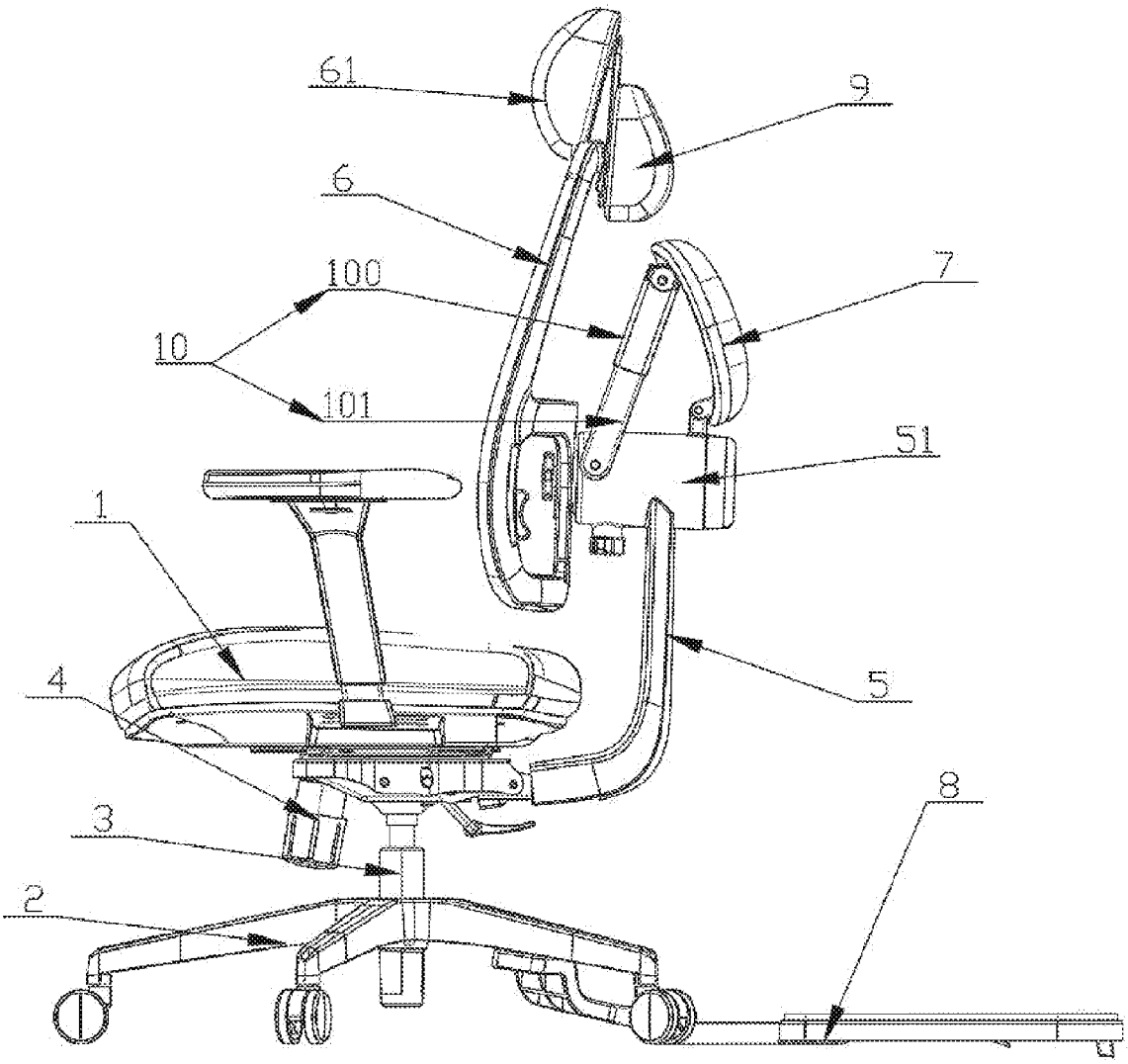
FIG. 2 is a lateral view of the ergonomic sit-stand chair according to the present disclosure.
Figure 3:
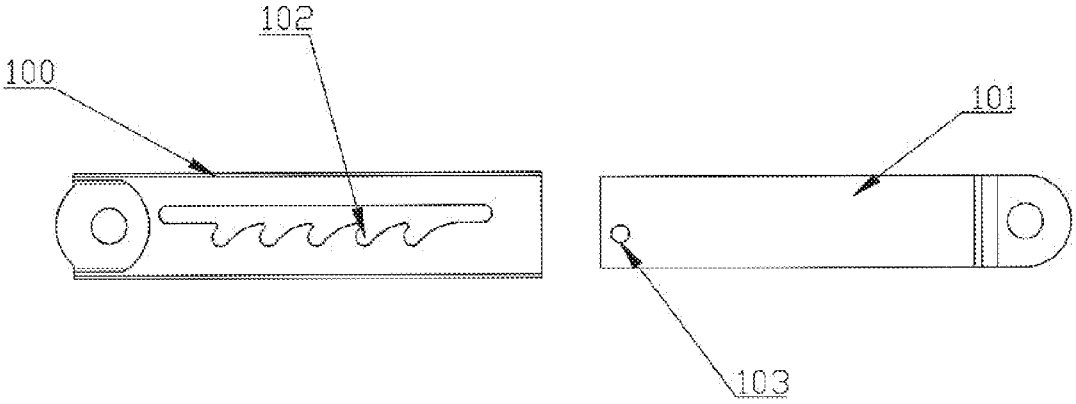
FIG. 3 is a schematic diagram of an angle adjustment mechanism according to the present disclosure.
Figure 4:
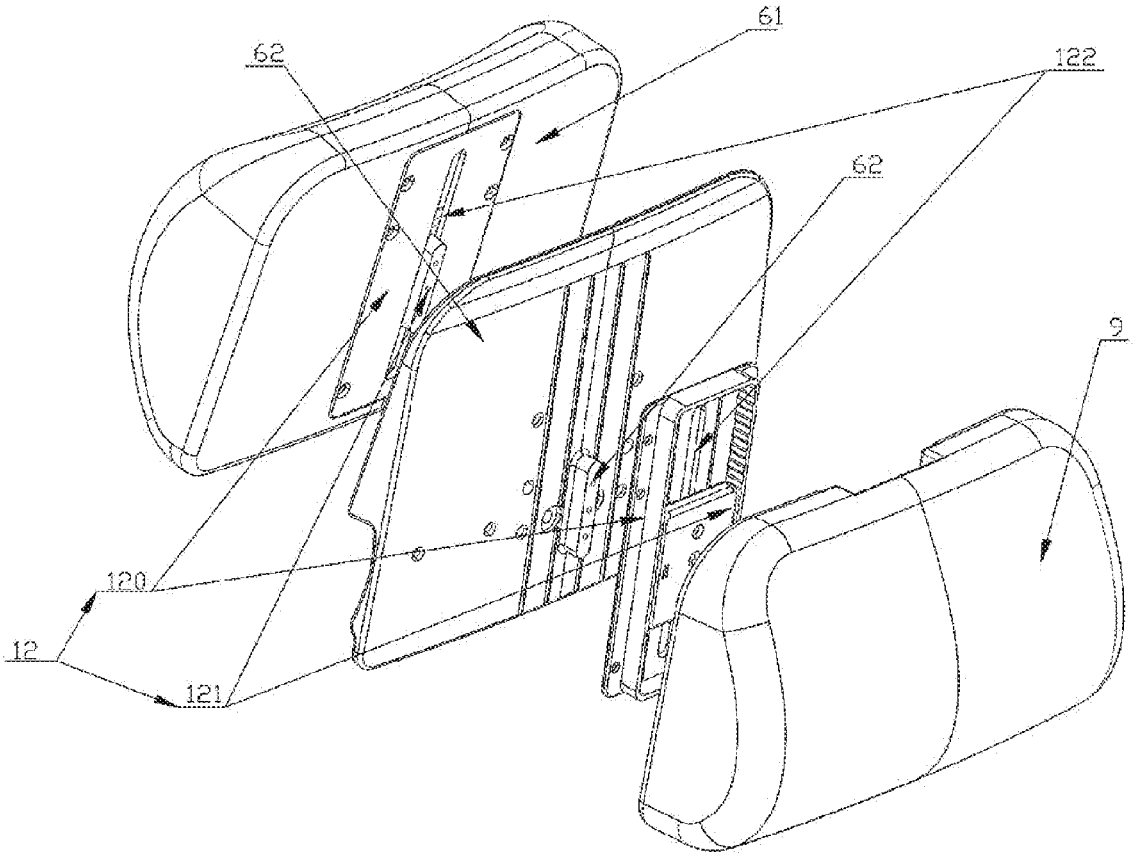
FIG. 4 is a schematic diagram of a backrest adjustment mechanism according to the present disclosure.
Figure 5:
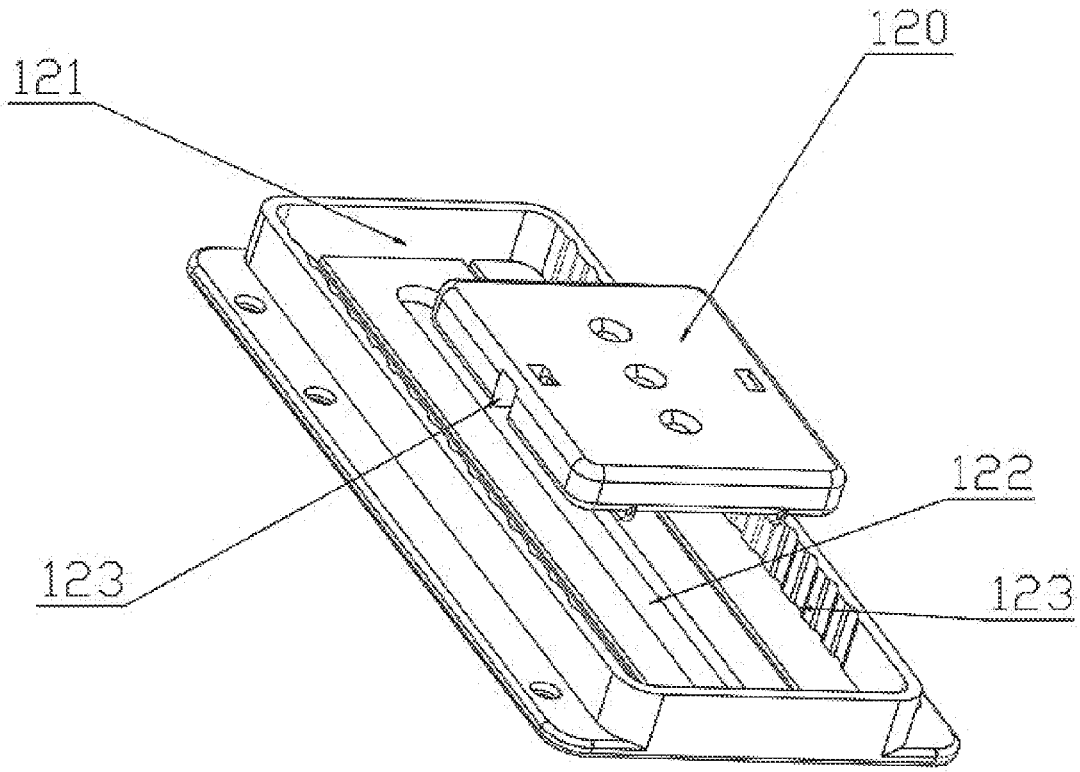
FIG. 5 is an exploded view of the backrest adjustment mechanism according to the present disclosure.

As shown in FIGS. 1 to 5, the present disclosure provides an ergonomic sit-stand chair, including first chair base 2, pneumatic rod 3, and first seat 1 connected in sequence, as well as first backrest 6 and backrest bracket 5. The first seat 1 is connected to one end of the backrest bracket 5, and the other end of the backrest bracket 5 is connected to the first backrest 6. The first chair base 2 is provided with second chair base 8 and storage mechanism 11. The second chair base 8 is connected to the first chair base 2 in a flipping manner through the storage mechanism 11. The first seat 1 is connected to the pneumatic rod 3 through seat adjustment mechanism 4. The seat adjustment mechanism is configured to adjust the comfort of the ergonomic sit-stand chair, and the ergonomic sit-stand chair technology in the prior art is currently relatively mature. Therefore, the present disclosure does not elaborate too much on the specific seat adjustment function. In the present disclosure, the standing position of the ergonomic sit-stand chair is mainly achieved through the second chair base 8. The second chair base 8 is connected to the first chair base 2 in a movable or flipping manner. When in use, the user only needs to lean on the first backrest 6 and press his/her feet against the second chair base 8. The user can utilize the frictional force between his/her feet and the second chair base 8 to counteract the gravity the user generates towards the second seat 7, preventing the seat from sliding and shifting towards the leaning direction due to the user's gravity. The user can flexibly switch between standing and sitting positions, improving the practicality of the product. It should be noted that the second chair base 8 can also be located on both sides of an armrest of the first seat 1, and the user can lean against the armrest. The specific position of the second chair base is not limited.

The working principle of the present disclosure is as follows.

When in use, first, the second chair base 8 is removed. By flipping first connecting element 111 and second connecting element 112, the second chair base 8 is removed and laid flat on the ground. Then, the position of the second seat 7 and the second backrest are adjusted. The second seat 7 is flipped upwards, and limit rods 100 move with the movement of the second seat 7. Limit protrusion 103 of clamping rod 101 embedded in the limit rod 100 extends out of limit hole 102 of the limit rod 100 to fix the position of the limit rod 100 and thus fix the angle of the second seat 7. First sliding element 120 and second sliding element are configured to adjust positions of the second backrest and a back plate, respectively. Edges of the first sliding element 120 and the second sliding element are respectively provided with clamping grooves that are that matches second fixing element 121 and third fixing element 110. The clamping groove is engaged with a limiting protrusion inside the fixing element 110 to fix the position of the second backrest. When an appropriate position is adjusted, the user can lean his/her upper body against the second seat 7 and second backrest 9. That is, the second seat 7 and the second backrest 9 support the user. When the user leans against the second seat 7 and the second backrest 9, corresponding gravity is generated, causing the entire chair to be subjected to force and undergo displacement. Therefore, the user's feet are pressed against the second chair base 8, such that the gravity and the frictional force generated between the user's feet and the second chair base 8 cancel each other out, causing the chair to remain stationary.

In this embodiment, the ergonomic sit-stand chair further includes the second seat 7 and angle adjustment mechanism 10. The second seat 7 is movably provided on the backrest bracket 5 through the angle adjustment mechanism 10. The second seat 7 achieves angle adjustment relative to the backrest bracket 5 through the angle adjustment mechanism 10. The second seat 7 and the second chair base 8 cooperate with each other to improve the comfort of standing. The user can place his/her buttocks on the second seat 7 to reduce leg stress, achieve easy standing and easy force application. The angle adjustment mechanism 10 includes the limit rods 100 and the clamping rods 101. One of the clamping rods 101 includes one end slidably embedded in one of the limit rods 100 and the other end hinged to the backrest adjustment mechanism. One end of at least one of the limit rods 100 away from the clamping rod 101 is hinged to the second seat 7. The limit rod 100 is provided with at least one limit hole 102. Multiple limit holes 102 are spaced apart. The clamping rod 101 is provided with at least one limit protrusion 103 that matches the limit hole 102. The second seat 7 achieves use angle adjustment relative to the backrest bracket 5 through the angle adjustment mechanism 10. Specifically, the clamping rod 101 is provided with the limit protrusion 103. When the clamping rod 101 is extended and retracted, the limit protrusion 103 is engaged with limit holes 102 at different positions of the limit rod 100 to fix the angle and position of the second seat 7.

In this embodiment, the storage mechanism 11 includes the fixing element 110, the first connecting element 111, and the second connecting element 112 that are connected in sequence in a flipping manner. One end of the fixing element 110 away from the first connecting element 111 is fixedly provided on the first chair base 2. One end of the second chair base 8 forms a connecting port 13. One end of the second connecting element 112 away from the first connecting element 111 is connected to the second chair base 8 in a flipping manner. When the first connecting element 111 and the second connecting element 112 are flipped, the second chair base 8 is folded and stored between the first seat 1 and the first chair base 2, with the connecting port 13 coming into contact with the pneumatic rod 3. By flipping the first connecting element 111 and the second connecting element 112, the connecting port 13 of the second chair base 8 is in contact with the pneumatic rod 3. The overall volume of the second chair base 8 is relatively large, which will take up a lot of space. Therefore, the storage mechanism 11 is provided to store and hide the second chair base 8 under the seat, thereby reducing the occupied space. The second chair base 8 is in contact with the pneumatic rod 3 through the connecting port 13 formed at one end of the second chair base 8. Meanwhile, the first connecting element 111 and the second connecting element 112 are hinged to the fixing element 110 and the connecting port 13, respectively, such that the second chair base 8 can be folded and flipped for storage or takeout for use. The storage mechanism 11 saves space occupied by the second chair base 8 and is convenient for folded storage or takeout for use. In addition, a surface of the second chair base 8 is provided with an anti-slip layer to increase the frictional force between the user's feet and the second chair base 8. The design enhances foot grip to prevent the user from slipping.

In this embodiment, in order to improve the comfort of standing and increase the user's force application, the ergonomic sit-stand chair further includes the second backrest 9, backrest adjustment mechanisms 12, and connecting back plate 62. Two opposite sides of the second backrest 9 and the chair headrest 61 are respectively embedded with the backrest adjustment mechanisms 12. The first backrest 6 is further provided with the chair headrest 61. The connecting back plate 62 is located between the second backrest 9 and the chair headrest 61 and is slidably connected to the backrest adjustment mechanisms 12 of the second backrest 9 and the chair headrest 61. The backrest adjustment mechanism 12 includes the first sliding element 120 and the second fixing element 121. The first sliding element 120 is provided inside the second fixing element 121. The second fixing element 121 is provided with strip notch 122, and the first sliding element 120 is provided with a strip groove. Two sides of the connecting back plate 62 are each provided with connecting post 63. The connecting post 63 at each of the two sides of the connecting back plate 62 is embedded into the strip groove of the first sliding element 120 through the strip notch 122 of the second fixing element 121, such that the connecting back plate 62 is fixedly connected to the first sliding element 120. Two sides of the first sliding element are each provided with a limit slot, while the second fixing element is provided with a limit tooth that matches the limit slot. The second backrest 9 is mainly configured to increase the user's standing comfort and protect the user's waist or back. The backrest adjustment mechanism allows the second backrest 9 to slide up and down. The second backrest 9 is mainly locked and adjusted by sliding the first sliding element 120 to engage the limit tooth with the limit slot. Adaptive adjustments can be made based on the user's height ratio. The second backrest 9 is further configured to increase the user's point of force when standing, allowing the user to stand in a more stable position.

The present disclosure has the following advantages.

The second seat and the second backrest are provided to achieve the standing function of the ergonomic sit-stand chair. The second seat and the second backrest achieve angle and height adjustments, respectively, allowing the user to flexibly adjust the most suitable use angle. In the present disclosure, the second chair base avoids seat displacement. The ergonomic sit-stand chair is further provided with a storage mechanism. The storage mechanism folds the second chair base and stores it between the seat and the first chair base, reducing space occupation. The product improves the user experience, alleviates problems such as lumbar fatigue and soreness during prolonged sitting, and provides the user with two use positions: standing and sitting.

The above disclosed are only the specific embodiments of the present disclosure, but the present disclosure is not limited thereto, and all variations conceivable to those skilled in the art should fall within the protection scope of the present disclosure.

What is claimed is:

1. An ergonomic sit-stand chair, comprising a first chair base, a pneumatic rod, and a first seat connected in sequence, as well as a first backrest and a backrest bracket, wherein the first seat is connected to a first end of the backrest bracket, and a second end of the backrest bracket is connected to the first backrest; the first chair base is provided with a second chair base and a storage mechanism; and the second chair base is connected to the first chair base in a flipping manner through the storage mechanism; and the storage mechanism comprises a fixing element, a first connecting element, and a second connecting element, wherein the fixing element, the first connecting element, and the second connecting element are connected in sequence in a flipping manner; one end of the fixing element away from the first connecting element is fixedly provided on the first chair base; one end of the second chair base forms a connecting port; one end of the second connecting element away from the first connecting element is provided in the connecting port and connected to the second chair base in a flipping manner; and by flipping the first connecting element and the second connecting element, the second chair base is folded and stored between the first seat and the first chair base, with the connecting port coming into contact with the pneumatic rod.

2. An ergonomic sit-stand chair, comprising a first chair base, a pneumatic rod, and a first seat connected in sequence, as well as a first backrest and a backrest bracket, wherein the first seat is connected to a first end of the backrest bracket, and a second end of the backrest bracket is connected to the first backrest; the first chair base is provided with a second chair base and a storage mechanism; and the second chair base is connected to the first chair base in a flipping manner through the storage mechanism; and the ergonomic sit-stand chair further comprises a second seat and an angle adjustment mechanism; the second seat is movably provided on the backrest bracket through the angle adjustment mechanism; and the second seat achieves angle adjustment relative to the backrest bracket through the angle adjustment mechanism.

3. The ergonomic sit-stand chair according to claim 2, wherein the angle adjustment mechanism is located on the first backrest; the angle adjustment mechanism comprises limit rods and clamping rods; one of the clamping rods comprises a first end slidably embedded in one of the limit rods and a second end hinged to the first backrest; one end of at least one of the limit rods away from the clamping rod is hinged to the second seat; the limit rod is provided with at least one limit hole; and the clamping rod is provided with at least one limit protrusion, wherein the at least one limit protrusion matches the limit hole.

4. The ergonomic sit-stand chair according to claim 3, wherein when at least two limit holes are provided, the at least two limit holes are spaced apart.

5. An ergonomic sit-stand chair, comprising a first chair base, a pneumatic rod, and a first seat connected in sequence, as well as a first backrest and a backrest bracket, wherein the first seat is connected to a first end of the backrest bracket, and a second end of the backrest bracket is connected to the first backrest: the first chair base is provided with a second chair base and a storage mechanism; and the second chair base is connected to the first chair base in a flipping manner through the storage mechanism; and the ergonomic sit-stand chair further comprises a second backrest, backrest adjustment mechanisms, and a connecting back plate; the first backrest is further provided with a chair headrest; the second backrest is opposite to the chair headrest; two opposite sides of the second backrest and the chair headrest are respectively embedded with the backrest adjustment mechanisms; and the connecting back plate is located between the second backrest and the chair headrest and is slidably connected to the backrest adjustment mechanisms of the second backrest and the chair headrest.

6. The ergonomic sit-stand chair according to claim 5, wherein the backrest adjustment mechanism comprises a first sliding element and a second fixing element; the first sliding element is provided inside the second fixing element; the second fixing element is provided with a strip notch, and the first sliding element is provided with a strip groove; two sides of the connecting back plate are each provided with a connecting post; the connecting post at each of the two sides of the connecting back plate is embedded into the strip groove of the first sliding element through the strip notch of the second fixing element, wherein the connecting back plate is fixedly connected to the first sliding element; and two sides of the first sliding element are each provided with a limit slot, while the second fixing element is provided with a limit tooth, wherein the limit tooth matches the limit slot.

7. The ergonomic sit-stand chair according to claim 1, wherein a surface of the second chair base is provided with an anti-slip layer.

* * * * *